US010165834B2

(12) United States Patent
Zhao

(10) Patent No.: US 10,165,834 B2
(45) Date of Patent: Jan. 1, 2019

(54) SWITCHABLE BUCKLE JEWELRY LOCK CATCH

(71) Applicant: Wei Zhao, Guangzhou (CN)

(72) Inventor: Wei Zhao, Guangzhou (CN)

( * ) Notice: Subject to any disclaimer, the term of this patent is extended or adjusted under 35 U.S.C. 154(b) by 0 days.

(21) Appl. No.: 15/626,108

(22) Filed: Jun. 17, 2017

(65) Prior Publication Data

US 2017/0280836 A1 Oct. 5, 2017

Related U.S. Application Data

(63) Continuation of application No. PCT/CN2015/000699, filed on Oct. 19, 2015.

(30) Foreign Application Priority Data

Dec. 18, 2014 (CN) ..... 2014 1 0783203

(51) Int. Cl.
*A44C 5/20* (2006.01)

(52) U.S. Cl.
CPC ..... *A44C 5/2076* (2013.01); *A44C 5/2061* (2013.01)

(58) Field of Classification Search
CPC ... A44C 5/2076; A44C 5/2061; A44C 5/2057; A44C 17/2016; Y10T 24/44581; Y10T 24/44607; Y10T 24/45016; Y10T 24/45094; Y10T 24/45089; Y10T 24/45188; Y10T 24/4522; Y10T 24/4578; Y10S 24/60; F16B 7/20
USPC ..... 63/3.1
See application file for complete search history.

(56) References Cited

U.S. PATENT DOCUMENTS 838,859 A * 12/1906 Hills ..... A44C 5/2042 24/587.11
845,654 A * 2/1907 Layng ..... B64D 17/32 24/573.11
867,162 A * 9/1907 Seidl ..... A44C 5/22 24/574.1
3,286,316 A * 11/1966 Marosy ..... A44C 5/2061 24/574.1
3,540,087 A * 11/1970 Marosy ..... F16B 7/20 24/573.11
3,933,011 A * 1/1976 DiGilio ..... A44C 17/0208 403/349

(Continued)

FOREIGN PATENT DOCUMENTS

DE 19919074 A1 * 11/2000 ..... A44C 5/2061

*Primary Examiner* — Robert Sandy
*Assistant Examiner* — Rowland Do
(74) *Attorney, Agent, or Firm* — Wayne & Ken, LLC; Tony Hom

(57) ABSTRACT

Provided is a buckle type jewelry lock catch. The lock catch includes a lock catch body, a buckle sleeve and a buckle. One end of the buckle sleeve is provided with a buckle sleeve matching surface, the other end of the buckle sleeve is provided with a buckle inlet, and an internal wall of the buckle sleeve is provided with lock pins; an external surface of the buckle is provided with U-shaped clamping grooves, a spring chamber is provided inside the buckle, and a spring is provided in the spring chamber; and a thimble of the spring is provided at one end of the buckle, and a connecting mechanism of a jewelry chain is provided at the other end of the buckle. The buckle type jewelry lock catch effectively combines firmness with beautiful appearance.

9 Claims, 6 Drawing Sheets

(56) References Cited

U.S. PATENT DOCUMENTS

| | | | | | |
|---|---|---|---|---|---|
| 4,216,567 | A * | 8/1980 | Heinz | A44C 5/2061 | 24/116 A |
| 4,622,726 | A * | 11/1986 | Nakamura | A44C 5/2057 | 24/303 |
| 4,679,959 | A * | 7/1987 | Cavallaro | F16B 7/20 | 24/573.11 |
| 4,982,581 | A * | 1/1991 | Furuyama | A44C 17/0216 | 24/303 |
| 5,180,284 | A * | 1/1993 | Monrose, III | F04D 29/364 | 403/349 |
| 5,367,891 | A * | 11/1994 | Furuyama | A44C 5/2057 | 24/303 |
| 5,456,095 | A * | 10/1995 | Tawil | A44C 17/0216 | 24/574.1 |
| 6,883,211 | B2 * | 4/2005 | Hoshino | A44C 5/2061 | 24/663 |
| 7,980,781 | B2 * | 7/2011 | Trice | B25G 1/04 | 403/109.3 |
| 8,197,155 | B2 * | 6/2012 | Noh | B60T 11/046 | 188/2 D |
| 8,607,399 | B2 * | 12/2013 | Umbrell | B24B 45/006 | 15/209.1 |
| 8,764,050 | B2 * | 7/2014 | Baumgartner | B60R 21/2171 | 280/728.2 |
| 8,789,851 | B2 * | 7/2014 | Alvarado | B60R 22/18 | 24/663 |
| 9,351,544 | B2 * | 5/2016 | Matsumori | A44C 25/00 | |
| 2008/0047111 | A1 * | 2/2008 | Garber | A44C 5/2061 | 24/303 |

* cited by examiner

SWITCHABLE BUCKLE JEWELRY LOCK CATCH

TECHNICAL FIELD

The present invention relates to a jewelry lock catch, particularly to a switchable buckle jewelry lock catch, which is a preferred lock catch widely applied to pearl, jade and other bead chain jewelry; leather rope, rubber rope and other rope chain jewelry; and metal, gem and other chain jewelry.

BACKGROUND

With the growth in the living standard of people, the demands of women for jewelry products are continuously increased, and the consumption demands for jewelry chains are diversified, personalized and graded. In China, the styles of these jewelry are continuously updated in recent years, and the qualities thereof are continuously improved. However, lock catches of these jewelry are single in variety and obsolete in style, which are in sharp contrast to various varieties and styles of jewelry lock catches of the European and American developed countries, thereby being not beneficial to improving the grades of jewelry of China. For the traditional jewelry chain lock catches, most lock catches are spring leaf lock catches and spring lock catches, but these lock catches have the disadvantages of less style, lack of molding change, asymmetrical lock catch body shapes, and gradual decrease or loss of elasticity and occasionally have the situations where spring leaves are broken and the like. In addition, a magnetic lock catch in the prior art is easily opened by chance, and is opened under the action of small external force, so that jewelry is lost if not careful, causing unnecessary loss. Thus, the safety is very worrying. There is much inconvenience in using a threaded lock catch, the lock catch is small in volume, and threads at both ends are not easily butt-jointed while in use, thereby consuming labor and consuming time, so that a wearer cannot wear the jewelry for a long time and then her mood is affected.

SUMMARY

Aiming at the above-mentioned problem existing in the prior art, the present invention provides a switchable buckle jewelry lock catch, which can solve the problems of low firmness, single style, inconvenient wear and the like, and has the advantages of long service life and excellent decorativeness.

The present invention has the following technical solution:

The lock catch comprises a lock catch body, a buckle sleeve and a buckle, wherein one end of the buckle sleeve is provided with a buckle sleeve matching surface, the other end of the buckle sleeve is provided with a buckle inlet, and an internal wall of the buckle sleeve is provided with lock pins; an external surface of the buckle is provided with clamping grooves, a spring chamber is provided inside the buckle, and a spring is provided in the spring chamber; and a thimble of the spring is provided at one end of the buckle, and a connecting mechanism of a jewelry chain is provided at the other end of the buckle.

Both ends of the lock catch body are respectively provided with a through hole, and the buckle sleeve is provided in the through hole.

Each of the buckle sleeve and the buckle is of a cylindrical structure, and the external diameter of the buckle is less than the internal opening diameter of the buckle sleeve and is greater than the straight-line distance between two lock pins.

The buckle sleeve matching surface is provided with a buckle sleeve hole, and the size of the buckle sleeve hole is less than that of the thimble of the spring.

The lock pins are protruded from the internal wall of the buckle sleeve and are symmetrically provided at both sides of the internal wall.

The clamping grooves are U-shaped clamping grooves, each U-shaped clamping groove is of a groove structure, the U-shaped clamping grooves are symmetrically distributed at both sides of the buckle, and the straight-line distance between groove bottoms of the two U-shaped clamping grooves is less than that between the two lock pins. The width of the U-shaped clamping groove matches the diameter of the lock pin.

The U-shaped clamping groove is formed by communicating a long open end, a short closed end and a cambered surface travel groove, the long open end is of an open structure at one side of the buckle, the short closed end is of a closed structure on the buckle, and the long open end of the U-shaped clamping groove is communicated with the short closed end by the cambered surface travel groove.

A lug boss and a lug boss corner are respectively provided at both ends of the spring chamber; one side of the lug boss is connected to the thimble of the spring, and the other side of the lug boss is provided with a spring seat matching the spring.

The connecting mechanism is that: the lug boss corner is connected to a bead needle, and the bead needle is provided with a threading hole.

The connecting mechanism is that: the lug boss corner is connected to a chain bushing, and a cavity is provided in the chain bushing.

The present invention has the following advantages and effects:

1. The buckle sleeve is provided in the through hole of the lock catch body, the shape of the lock catch body may be varied, and the surface pattern may be designed at random; the lock catch body may be hollowly designed, thereby suitable for any metal and precious metal material. A consumer can replace the main lock catch body at random so long as she reserves the buckle sleeve while in use, and there is no need to destroy the bead chain connection, thereby making same have various styles.

2. If the lock catch is connected and used, when buckle is inserted in the buckle sleeve through the buckle inlet, the lock pin is required to be aligned with the long open end of the U-shaped clamping groove, the buckle and the buckle sleeve oppositely move under hand push, and the lock pin moves to the position connected to the cambered surface travel groove from the groove at the long open end of the U-shaped clamping groove. At this moment, the thimble of the spring comes into contact with the buckle sleeve matching surface, and compresses the spring under hand pressure. At this moment, the buckle clockwise rotates, and the lock pin slides to the position connected to the short closed end of the U-shaped clamping groove along the groove of the cambered surface travel groove. The handheld end of the buckle is released, and then the spring acts to push the lug boss connected to the thimble of the spring, so that the lock pin is locked in the groove at the short closed end, on the contrary, the lock catch may be opened by an operation.

3. According to the present invention, when a bead-shaped jewelry chain is connected, the thin end of the bead needle may be inserted in the threading hole of the bead and may be adhered by adhesive. The beading thread may pass through the threading hole to connect other beads, to play a role of connecting the whole bead chain.

4. According to the present invention, when a chain-shaped or a leather thread-shaped jewelry chain is connected, the buckle is connected to the chain bushing, and the leather rope, the metal chain and other jewelry chains may be connected in the cavity. Thus, various uses of the buckle type lock catch are realized.

To sum up, the present invention effectively combines firmness with beautiful appearance, and obtains unexpected technical effects, i.e. firmer and safer, thereby expanding the application range and being more suitable to be used in combination with precious jewelry. The style is fashionable, and the service life is long, which are taken as double insurance. Meanwhile, the present invention has decorativeness and artistry, thereby improving the competitive advantage of the product.

LEGENDS

1. lock catch body; 2. through hole; 3. buckle sleeve; 4. buckle; 5. external edge of buckle sleeve; 6. lock pin; 7. buckle inlet; 8. buckle sleeve matching surface; 9. U-shaped clamping groove; 10. thimble of the spring; 11. lug boss; 12. spring; 13. spring seat; 14. bead needle; 15. lug boss corner; 16. threading hole; 17. spring chamber; 18. cavity; 19 chain bushing; 20. buckle sleeve hole; 21. long open end; 22. short closed end; 23 cambered surface travel groove.

DETAILED DESCRIPTION

The content the present invention will be further described in detail through specific embodiments in combination with the figures.

Embodiment 1

Figure 1:
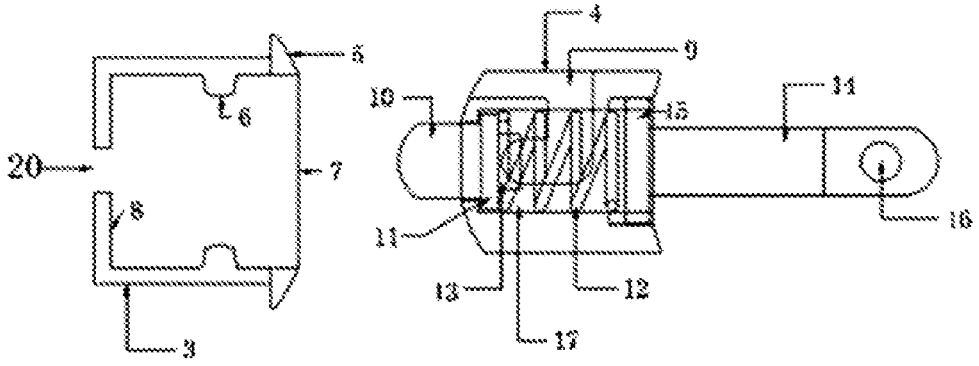
FIG. 1 is a schematic diagram of a structure of the present invention.
Figure 2:
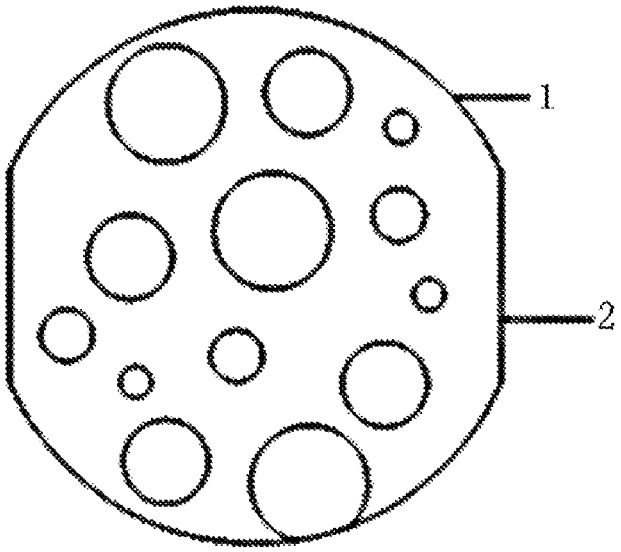
FIG. 2 is a schematic diagram of a sectional structure of a lock catch body.
Figure 3:
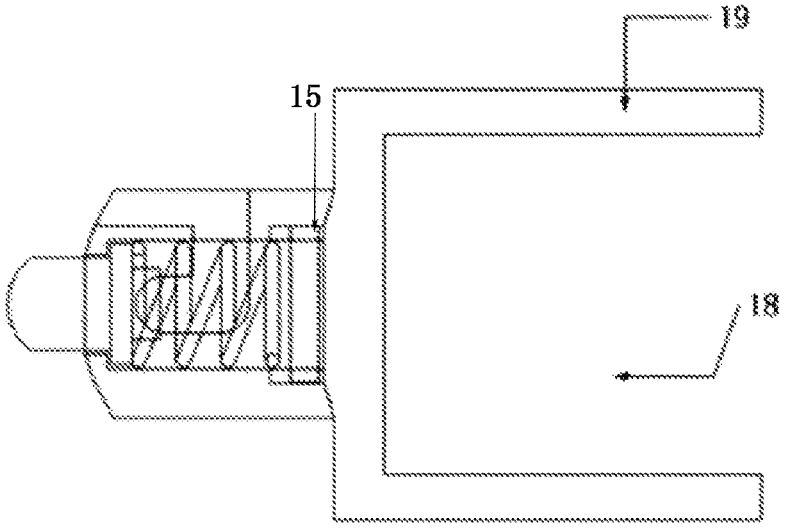
FIG. 3 is a schematic diagram of an embodiment structure of a buckle and a connecting mechanism.
Figure 4:
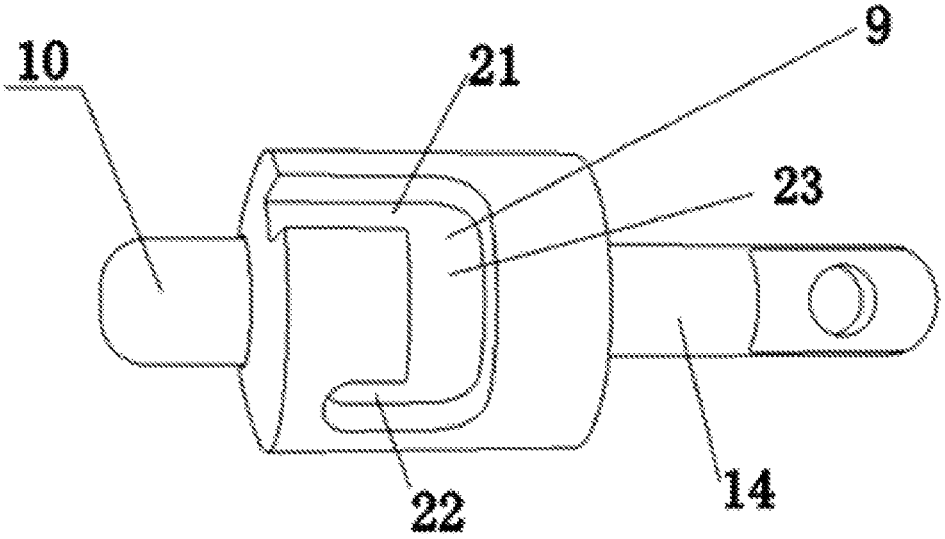
FIG. 4 is a schematic diagram of a local structure of a buckle.
Figure 5A:
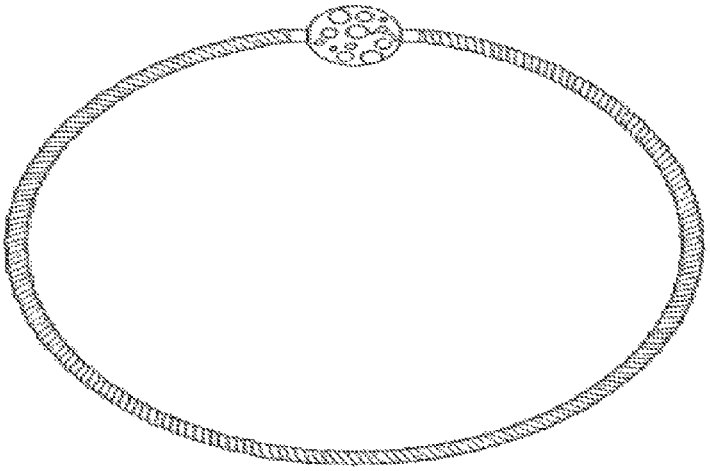
FIG. 5*a* is a schematic diagram of a structure connected to a cotton rope in an embodiment of the present invention.
Figure 5B:
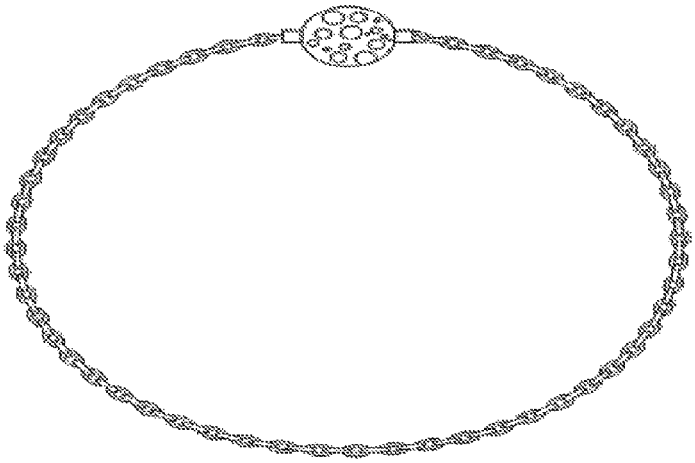
FIG. 5*b* is a schematic diagram of a structure connected to a metal chain in an embodiment of the present invention.
Figure 5C:
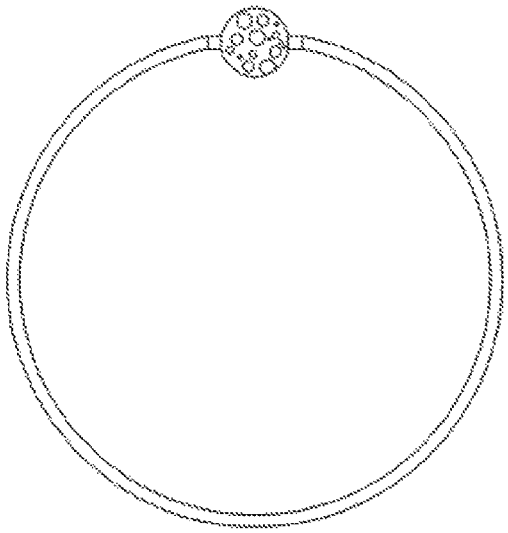
FIG. 5*c* is a schematic diagram of a structure connected to a leather rope in an embodiment of the present invention.
Figure 5D:
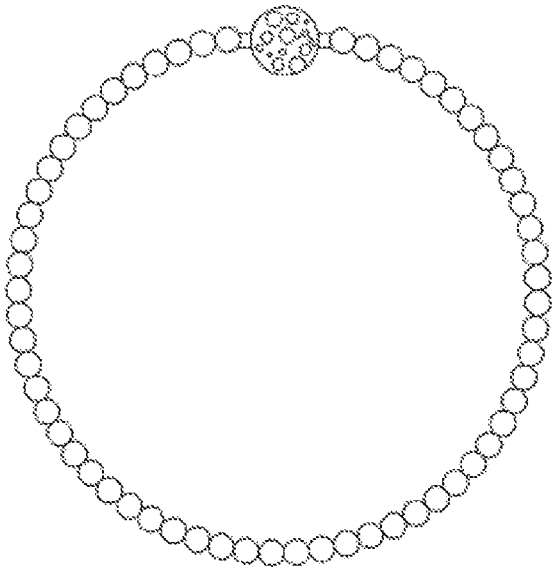
FIG. 5*d* is a schematic diagram of a structure connected to a bead china in an embodiment of the present invention.

As shown in FIGS. 1, 2 and 4, the lock catch comprises a lock catch body 1, a buckle sleeve 3 and a buckle 4, wherein both ends of the lock catch body 1 are respectively provided with a through hole 2, and the buckle sleeve 3 is connected in the through hole 2; one end of the buckle sleeve 3 is provided with a buckle sleeve matching surface 8, the buckle sleeve matching surface 8 is a fracture surface, the buckle sleeve matching surface is provided with a buckle sleeve hole 20, and the size of the buckle sleeve hole 20 is less than that of the thimble of the spring; the other end of the buckle sleeve 3 is provided with a buckle inlet 7, an internal wall of the buckle sleeve 3 is provided with lock pins 6, the lock pins 6 are cylindrically protruded from the internal wall of the buckle sleeve and are symmetrically provided at both sides of the internal wall; the buckle 4 is of a cylindrical structure, the external surface is provided with a pair of symmetrical U-shaped clamping grooves 9 of a groove structure, each U-shaped clamping groove 9 is formed by communicating a long open end 21, a short closed end 22 and a cambered surface travel groove 23, the long open end is of an open structure at one side of the buckle, the short closed end is of a closed structure on the buckle, the long open end of the U-shaped clamping groove is communicated with the short closed end by the cambered surface travel groove, the specification of the U-shaped clamping groove 9 matches that of the lock pin 6, and the external diameter of the buckle 4 is less than the internal opening diameter of the buckle sleeve and is greater than the straight-line distance between two lock pins. The straight-line distance between groove bottoms of the pair of symmetrical U-shaped clamping grooves 9 is less than that between the two lock pins. A spring chamber 17 is provided inside the buckle 4, a spring 12 is provided in the spring chamber 17, both ends of the spring chamber are respectively provided with a lug boss 11 and a lug boss corner 15, one side of the lug boss 11 is connected to a thimble 10 of the spring, the other side of the lug boss is provided with a spring seat 13, the spring seat 13 is connected to the spring 12, and the spring seat 13 plays a role of fixing the spring 12; and the other end of the buckle 4 is connected to a bead needle 14 by the lug boss corner 15, and the bead needle 14 is provided with a threading hole 16. The lug boss corner 15 and the bead needle 14 are connected to the buckle 4 by thread rotation, press fit or welding; when being applied to a bead-shaped jewelry chain, the bead needle 14 is adhered to jewelry beads by adhesive, and the beading thread passes through the threading hole 16 to connect other beads, to play a role of connecting the whole jewelry chain.

Embodiment 2

As shown in FIG. 3 and FIG. 5*a*-5*d*, when the lock catch is applied to a metal chain, a thread rope chain or a leather rope chain, the lug boss corner 15 is connected to the chain bushing 19, a cavity 18 is provided in the chain bushing 19, the metal chain or leather thread rope is connected in the cavity 18 in the chain bushing 19 by welding or adhesion, to play a role of connecting the whole jewelry chain, thereby realizing various uses of the buckle type lock catch; other structures are the same as embodiment 1.

If the buckle type lock catch is connected and used, when the buckle 4 is inserted in the buckle sleeve 3 through the buckle inlet 7, the lock pin 6 is required to be aligned with the long open end 21 of the U-shaped clamping groove 9, the buckle 4 and the buckle sleeve 3 oppositely move under hand push, and the lock pin 6 moves to the position connected to the cambered surface travel groove 23 from the groove at the long open end 21 of the U-shaped clamping groove 9. At this moment, the thimble 10 of the spring comes into contact with the buckle sleeve matching surface 8, and compresses the spring 12 under hand pressure. At this moment, the buckle 4 clockwise rotates, and the lock pin 6 slides to the position connected to the short closed end 22 of the U-shaped clamping groove 9 along the groove of the cambered surface travel groove 23. The handheld end of the buckle 4 is released, and then the spring 12 acts to push the lug boss 11 connected to the thimble of the spring 12, so that the lock pin 6 is locked in the groove at the short closed end 22, on the contrary, the lock catch may be opened by an operation.

The above describes preferred embodiments and used technical principles of the present invention. Any equivalent transformation made on the basis of the technical solution of the present invention shall belong to the protection scope of the present invention.

What is claimed is:

1. A switchable buckle jewelry lock catch, comprising a lock catch body, a buckle sleeve and a buckle; wherein one end of the buckle sleeve is provided with a buckle sleeve matching surface; the other end of the buckle sleeve is provided with a buckle inlet; an internal wall of the buckle sleeve is provided with lock pins; an external surface of the buckle is provided with clamping grooves; a spring chamber is provided inside the buckle; a spring is provided in the spring chamber; a thimble of the spring is provided at one end of the buckle; a connecting mechanism of a jewelry chain is provided at the other end of the buckle; the clamping grooves are U-shaped clamping grooves; each of the U-shaped clamping grooves is of a groove structure; the U-shaped clamping grooves are symmetrically distributed at two sides of the buckle; a straight-line distance between groove bottoms of the two U-shaped clamping grooves is less than a straight-line distance between the lock pins; and a width of the U-shaped clamping groove matches a diameter of each of the lock pins.

2. The switchable buckle jewelry lock catch according to claim 1, wherein a through hole is provided at each of two ends of the lock catch body; and the buckle sleeve is provided in the through hole.

3. The switchable buckle jewelry lock catch according to claim 1, wherein each of the buckle sleeve and the buckle is of a cylindrical structure; and an external diameter of the buckle is less than an internal opening diameter of the buckle sleeve and is greater than a straight-line distance between two lock pins.

4. The switchable buckle jewelry lock catch according to claim 1, wherein the buckle sleeve matching surface is provided with a buckle sleeve hole, and a size of the buckle sleeve hole is less than a size of the thimble of the spring.

5. The switchable buckle jewelry lock catch according to claim 1, wherein the lock pins are protruded from the internal wall of the buckle sleeve and are symmetrically provided at two sides of the internal wall.

6. The switchable buckle jewelry lock catch according to claim 1, wherein the U-shaped clamping groove is formed by communicating a long open end, a short closed end and a cambered surface travel groove, the long open end is of an open structure at one side of the buckle, the short closed end is of a closed structure on the buckle, and the long open end of the U-shaped clamping groove is communicated with the short closed end by the cambered surface travel groove.

7. The switchable buckle jewelry lock catch according to claim 1, wherein a lug boss is provided at one end of the spring chamber and a lug boss corner is provided at the other end of the spring chamber; and one side of the lug boss is connected to the thimble of the spring, and the other side of the lug boss is provided with a spring seat wherein the spring seat is matched with the spring.

8. The switchable buckle jewelry lock catch according to claim 1, wherein a lug boss corner is connected to a bead needle; and the bead needle is provided with a threading hole.

9. The switchable buckle jewelry lock catch according to claim 1, wherein a lug boss corner is connected to a chain bushing; and a cavity is provided in the chain bushing.

* * * * *